United States Patent [19]

Schaller

[11] Patent Number: 4,505,177

[45] Date of Patent: Mar. 19, 1985

[54] ATTACHMENT FOR RELEASABLY HOLDING STEMMED TOOLS

[76] Inventor: Helmut F. K. Schaller, Postfach 1225, D-8501 Feucht 1, Fed. Rep. of Germany

[21] Appl. No.: 532,209

[22] Filed: Sep. 14, 1983

[51] Int. Cl.[3] ..... G10D 3/00

[52] U.S. Cl. ..... 84/329

[58] Field of Search ..... 84/329, 458

[56] References Cited

U.S. PATENT DOCUMENTS 631,729 8/1899 Smith ..... 84/329

4,135,431 1/1979 Ferguson ..... 84/329

*Primary Examiner*—Benjamin R. Fuller

*Attorney, Agent, or Firm*—McCormick, Paulding & Huber

[57] ABSTRACT

An attachment is provided for use with a guitar or other musical instrument or other mechanism for conveniently releasably holding stemmed tools, such as hexagonal or octagonal wrenches, used in adjusting or otherwise servicing the mechanism. The attachment is a small body which can be nonrotatably attached to an instrument or other mechanism by a single screw. The tools are frictionally held to the attachment so that no manipulation of it is required to either insert or remove a tool.

9 Claims, 6 Drawing Figures

ATTACHMENT FOR RELEASABLY HOLDING STEMMED TOOLS

BACKGROUND OF THE INVENTION

This invention relates to tools holders, and deals more particularly with a tool holder in the form of a small attachment usable with a guitar, other musical instrument or other mechanism, for releasably holding one or a small number of tools frequently used in the adjustment of other servicing of the mechanism in such a way that the tools may be rapidly and easily inserted into and removed from the holder and yet be held firmly in place by the holder when not in use.

The tool holder-type attachment of this invention is particularly useful for use with guitars to hold one or two, or possibly more, hexagon wrenches or octagon wrenches of the common L-shape variety, which wrenches are used in adjusting parts of the guitar such as when changing the position of the string supporting saddles of a tailpiece-bridge or changing the positions of the pole pieces of an electric pickup. However, the attachment may be used with various other types of mechanism to hold various different types of stemmed tools and the invention is therefore not limited to use with guitars or other stringed instruments but can as well be used with other types of mechanisms in general.

The general object of the invention is, therefore, to provide a simple device for attachment to a mechanism to hold a small number of tools usable with the mechanism and in the case of which the tools are easily insertable into and removable from the attachment with no special manipulation of the attachment being required and whereby the tools are held firmly in place by the attachment when not in use.

Other objects and advantages of the invention will be apparent from the following detailed description of a preferred embodiment.

SUMMARY OF THE INVENTION

The invention resides in a device for attachment to a musical instrument or other mechanism to hold one or more stemmed tools used in servicing the mechanism with the device comprising a main body flatly attachable to a surface of the mechanism by a single screw and with the body having at least one anti-rotation lug extending rearwardly from its rear face. The main body further has at least one, and preferably two, tool-receiving apertures extending through it each along an axis located in a plane perpendicular to the screw aperture axis and spaced from the screw aperture axis with each such tool-receiving aperture having associated with it a means for frictionally engaging the stem of a tool inserted in the aperture.

The invention further resides in the body of the attachment having two anti-rotation lugs projecting rearwardly from its rear surface, in the body being shaped to have two wing portions extending in opposite directions from the axis of the screw aperture with each wing portion including at least one tool-receiving aperture, and in the means for holding a tool in each tool-receiving aperture being a spring-biased detent, such as a ball, for frictionally engaging the tool.

DETAILED DESCRIPTION OF THE PREFERRED EMBODIMENTS

Figure 1:
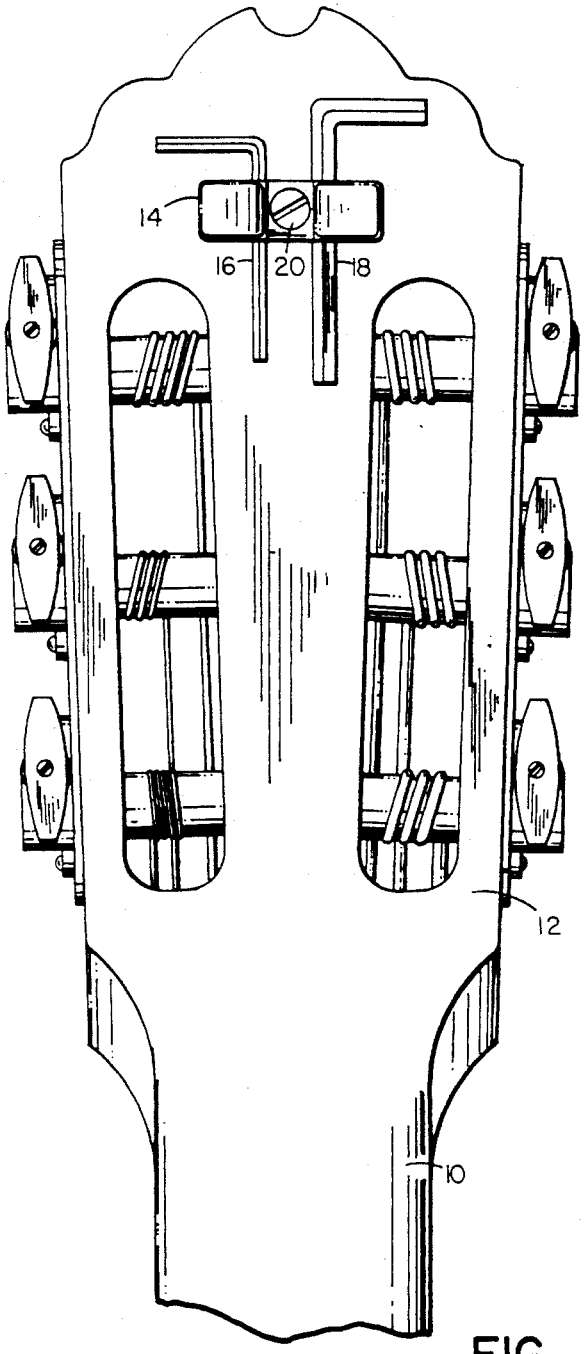
FIG. 1 is a view showing a tool holder embodying this invention attached to a guitar.
Figure 2:
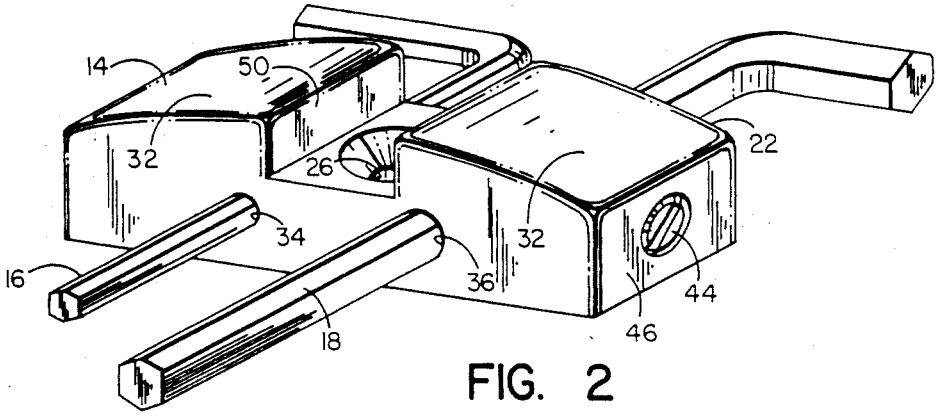
FIG. 2 is an enlarged perspective view of the tool holder of FIG. 1.

As shown by FIG. 1, a guitar neck 10 has attached to its rear face 12, in the vicinity of the peghead, a device 14 embodying the present invention and designed to hold up to two tools for use in servicing the guitar. These tools may take various different forms so long as they include a stem insertable in the holder 14, and in the illustrated case are shown to be two L-shaped hexagonal or octagonal wrenches 16 and 18 respectively. The device 14 is in turn fastened to the guitar neck 10 by a single screw 20.

FIGS. 2 through 6 show in more detail the construction of the device 14 of FIG. 1 and, referring to these figures, the device is seen to comprise a unitary body 22 which is preferably made of metal but which may, if desired, also be made of plastic or other suitable rigid material. The body 22 has a generally planar rear surface 24 adapted to flatly engage the conforming surface 12 of the guitar or other mechanism to which it is attached. A screw aperture 26 extends through the body 22 along an axis 28 generally perpendicular to the rear surface 24 and located generally centrally of the rear surface 24, the purpose of the aperture 26 being to receive the screw 20 used to fasten the device to the guitar or other mechanism.

In order to permit the attachment of the body 22 to a mechanism by a single screw, such as the screw 20, and yet prevent rotation of the body relative to the mechanism, the body 22 has at least one, and, as shown, preferably two anti-rotation lugs 30, 30 extending rearwardly from the rear face 24 and located in spaced relation to the screw aperture axis 28. In the illustrated case the two anti-rotation lugs 30, 30 are spaced equal distances from the axis 28, on opposite sides of it, with the axes of the two lugs 30, 30 and the axis 28 all being located in a common plane. When the body 22 is attached to a mechanism surface by a screw the anti-rotation lugs 30, 30 are received in conforming recesses or holes in the mechanism surface.

Figure 3:
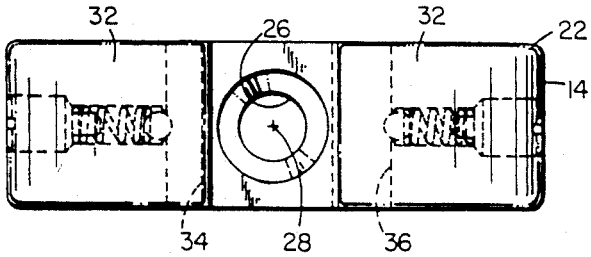
FIG. 3 is a plan view of the tool holder of FIG. 1.

The body 22 of the device 14 is of a somewhat elongated shape as seen in FIG. 3 and comprises two lateral wings 32, 32, extending in opposite directions from the axis 28 of the screw opening 26. Each wing 32 includes one tool-receiving aperture 34 or 36 which extends through the body 22 along an axis located in a plane perpendicular to the screw aperture axis 28.

Figure 6:
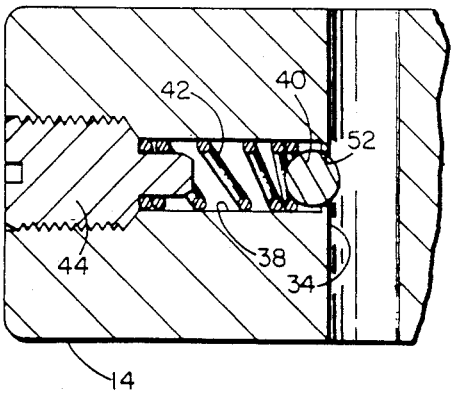
FIG. 6 is an enlarged sectional view taken on the line 6—6 of FIG. 4.

As best seen in FIG. 6, associated with each tool-receiving aperture 34 or 36 is a laterally extending detent opening 38 which receives a detent element in the form of a ball 40, and a compression spring 42 and which is sealed by a closure member 44 threadably connected with the body 22. Each detent opening 38 slidably receives its ball detent 40 and at the inner end of each detent opening the detent opening communicates with its associated tool-receiving aperture 34 or 36 and includes a seat 52 adjacent the inner end of the opening of smaller diameter than the ball 40 so as to limit movement of the ball toward the associated tool-receiving aperture but allowing a portion of the ball to protrude into the tool-receiving aperture. The spring 42 of each detent opening is compressed between the ball 40 and the closure member 44 and therefore urges the ball against its seat and resiliently resists movement of the ball away from such position. Therefore, when the stem of a tool is inserted in a tool-receiving opening, it will, provided it is of a proper sized cross section, push the associated ball slightly away from its seat to allow the insertion of the tool and thereafter the tool will be held in the holder by the friction of the ball pressing against the tool stem. However, the tool may be easily pulled from the tool-receiving aperture when it is needed without any manipulation of the holder being required.

Figure 5:
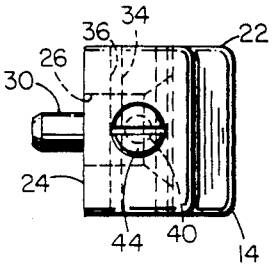
FIG. 5 is an end elevational view of the tool holder of FIG. 1.
Figure 4:
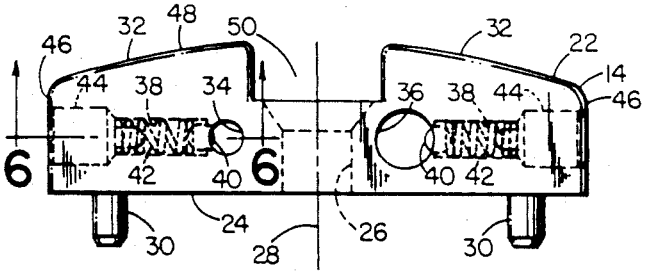
FIG. 4 is a side elevational view of the tool holder of FIG. 1.

It will also be observed from FIGS. 3, 4 and 5 that the detent openings 38 are located along a common line and have their outer ends communicating with the end surfaces 46, 46 of the body 22. Further, the body 22 has a front surface 48 which is recessed, as indicated at 50 in FIG. 4, in the vicinity of the screw aperture 26 with the screw aperture communicating with the bottom of the recess 50.

I claim:

1. A device for attachment to a musical instrument or other mechanism for use in holding one or more stemmed tools used in servicing the mechanism, said device comprising a main body having a generally planar rear face for engagement with a conforminig face of the mechanism to which it is to be attached, said body having a screw aperture passing therethrough generally perpendicular to said rear face for receiving a screw to fasten said body to a mechanism, at least one anti-rotation lug on said body projecting rearwardly from said rear face along an axis parallel to and spaced from the axis of said screw aperture for reception by a conforming recess in said mechanism face to prevent rotation of said body about the axis of said screw aperture after said body is fastened to said mechanism by a screw inserted through said screw aperture, said body also having a tool receiving aperture passing therethrough along an axis located in a plane perpendicular to said screw aperture axis and spaced from said screw aperture axis, and means carried by said body for frictionally engaging the stem of a tool inserted in said tool aperture so as to releasably hold such tool in said body.

2. A device as defined in claim 1 further characterized by said body having two anti-rotation lugs projected rearwardly from said rear face which two lugs are spaced equal distances from and on opposite sides of said axis of said screw aperture with the two axes of said lugs and the axis of said screw aperture being located in a common plane.

3. A device as defined in claim 1 further characterized by said main body having two wing portions extending in opposite directions from said screw aperture axis, each of said two wing portions having at least one tool receiving aperture passing therethrough along an axis located in a plane perpendicular to said screw aperture axis and spaced from said screw aperture axis, each of said tool receiving apertures having associated with it a means carried by said body for frictionally engaging the stem of a tool inserted in it so as to releasably hold such tool in said body.

4. A device as defined in claim 3 further characterized by said main body having a front face which front face has a rearwardly extending recess between said two wings in the vicinity of said screw aperture and with the bottom of which recess said screw aperture communicates.

5. A device as defined in claim 1 further characterized by said means for frictionally engaging the stem of a tool inserted in said tool aperture including a detent opening in said body extending laterally of said tool aperture and communicating at its inner end with said tool aperture, a detent element supported in said detent opening for movement along the length thereof, a seat at the inner end of said detent opening engageable with said detent element to limit its movement toward said tool aperture and at which so limited position of said detent element it projects partially into said tool aperture, a spring in said detent opening between said detent element and the outer end of said detent opening, and a closure member for said detent opening holding said spring in a compressed state between said closure member and said detent member so as to urge said detent member toward engagement with said seat and to yieldingly resist movement of said detent member away from said seat.

6. A device as defined in claim 5 further characterized by said detent member being a ball.

7. A device as defined in claim 1 further characterized by said main body having two wing portions extending in opposite directions from said screw aperture axis along a common line, each of said two wing portions having one tool-receiving aperture passing therethrough along an axis located in a plane perpendicular to said screw aperture and spaced from said screw aperture axis, a detent opening in each of said wings passing from the outer end of the wing to the associated tool aperture and communicating at its inner end with said tool aperture, a detent element supported in each of said detent openings for movement along the length of its associated detent opening, a seat at the inner end of each detent opening engageable with the associated detent element to limit its movement toward the associated tool aperture and at which so limited position of said detent element it projects partially into said associated tool aperture, a spring in each of said detent openings located between the associated detent element and the outer end of the detent opening, and a closure member for each of said detent openings holding the associated spring in a compressed state between the closure member and the associated detent member so as to urge such detent member toward engagement with its seat and to yieldingly resist movement of such detent member away from its seat.

8. A device as defined in claim 7 further characterized by said detent members being balls.

9. A device as defined in claim 7 further characterized by said closure members being elements threadably engaged with said main body.

* * * * *